US006240189B1

(12) United States Patent
Aylward

(10) Patent No.: US 6,240,189 B1
(45) Date of Patent: May 29, 2001

(54) GENERATING A COMMON BASS SIGNAL

(75) Inventor: J. Richard Aylward, Ashland, MA (US)

(73) Assignee: Bose Corporation, Framington, MA (US)

( * ) Notice: Subject to any disclaimer, the term of this patent is extended or adjusted under 35 U.S.C. 154(b) by 0 days.

(21) Appl. No.: 08/254,643

(22) Filed: Jun. 8, 1994

(51) Int. Cl.[7] ..... H04S 5/02; H04S 3/00
(52) U.S. Cl. ..... 381/18; 381/20; 348/480
(58) Field of Search ..... 381/20, 18, 1, 381/27, 28, 61; 348/738, 485, 483, 481

(56) References Cited

U.S. PATENT DOCUMENTS

| | | | | |
|---|---|---|---|---|
| 4,118,599 | | 10/1978 | Iwahara et al. | 179/1 |
| 4,905,284 | | 2/1990 | Kwang | 381/27 |
| 4,933,768 | * | 6/1990 | Ishikawa | 381/20 |

FOREIGN PATENT DOCUMENTS

| | | | | |
|---|---|---|---|---|
| 1175362 | * | 10/1984 | (CA) | 381/1 |
| 4013398 | | 10/1990 | (DE) | H04R/5/02 |
| 0 354 517 | | 2/1990 | (EP) | H04S/3/02 |
| WO919407 | * | 12/1991 | (WO) | 381/28 |
| WO 92/06568 | | 4/1992 | (WO) | H04R/5/02 |

OTHER PUBLICATIONS

EPO, European Search Report, Sep. 4, 1996, The Hague.

* cited by examiner

*Primary Examiner*—Jerome Grant, II
(74) *Attorney, Agent, or Firm*—Fish & Richardson P.C.

(57) ABSTRACT

A system for extracting a bass signal from left and right audio input signals of a stereo signal including a differencing circuit generating a difference mode signal from the left and right audio input signals; a detector circuit generating a first coefficient of proportionality that is a function of the relative phase of the left and right input signals; and a first multiplier circuit multiplying the first coefficient of proportionality times the difference mode signal to produce a modified difference mode signal, wherein the modified difference mode signal is used to generate the bass signal.

29 Claims, 8 Drawing Sheets

GENERATING A COMMON BASS SIGNAL

BACKGROUND OF THE INVENTION

The invention relates to extracting a common bass signal from a multi-channel audio signal.

In earlier days home stereo systems typically included only two speakers, one for the left channel and another for the right channel. Generally, each of the speakers was designed to reproduce both bass information (e.g. <200 Hz) and higher frequency information (>200 Hz). This meant that each speaker had to have a large woofer for low frequencies, and one or more smaller speakers for the higher frequencies. In other words, speaker enclosures for high quality systems tended to be large because accurate bass reproduction required large woofers.

More recently, stereo system designers have come to appreciate that it is not necessary that all speakers in a sound system be capable of reproducing the bass sound information. Bass after all is relatively omnidirectional which means that it is difficult to determine where it was coming from. Thus, a number of stereo system designers have moved away from using a bass woofer in each speaker enclosure and have instead used a single, separately located subwoofer for the entire stereo system. In such systems, the bass information that is present in each of the two stereo signals is extracted, combined, and sent to the single subwoofer. By not requiring the other speakers to also handle bass, the larger, relatively expensive woofers can be eliminated and the speakers can be made much smaller and less expensive. The reduction in size makes possible a much less conspicuous installation when the sound system is installed in the home.

As home speaker systems have become more sophisticated so too have the recorded sound tracks that are available for playback at home. For example, sound tracks now include audio information for more than two channels. In addition to left and right channels, there may also be a center channel and a surround channel. The center channel is played through speakers that are located in front of the audience and midway between the left and right speakers. The surround channel is played through two sets of speakers located behind the audience and on either side of the room. Of course, since typical home entertainment systems are designed to receive or handle only a stereo signals, they do not have the capability to extract more than two channels of sound from the recorded media. Thus, to make the multi-channel sound tracks compatible with home entertainment systems, the sound tracks are combined or encoded in some way to produce two audio channel signals that contain sound information for all four channels.

A popular method for encoding four channels into two channels for home stereo systems is the Dolby™ surround sound encoding technique illustrated in FIG. 1. In that diagram, the blocks with summation symbol (i.e., Σ) represent circuits which add the inputs to produce a summation signal and the blocks with the phase angle symbol (i.e., ϕ) represent all pass networks which are characterized by an amplitude response that is flat over the relevant frequency range and a phase response that varies linearly with frequency (i.e., all frequencies are delayed by the same phase). The circuit generates left total and right total channel audio signals, $L_t$ and $R_t$, as follows:

$$L_t=L+0.707C+0.707\,jS$$

$$R_t=R+0.707C-0.707\,jS,$$

where $j=(-1)^{1/2}$. That is, the surround channel signal appears in quadrature with the left, right, and center channel signals and the surround signal components of the left and right total channel signals are equal and 180° out of phase with each other.

On the decoding side of the system (e.g. during playback), a center channel signal is produced from the stereo signal by combining the left and right total channel signals, i.e., $$L_t+R_t=L+R+1.414C.$$

And a surround channel signal is produced by subtracting the left channel signal from the right channel signal, i.e., $$L_t-R_t=L-R+1.414jS.$$

Though this techniques does not recover each of the four channel signals separately, the decoded signals that are generated by this technique produce a psychoacoustic effect that is similar to a true four channel surround sound when played back in a four or five speaker system.

Note, however, that it is not readily apparent how to combine the signals so that a single subwoofer can be used to reproduce the entire bass as is done in the above-mentioned stereo system. Since low bass frequencies can originate as left, right, center, or surround channel information, all bass information cannot be represented by a simple summation of $L_t+R_t$. Such a simple summation would cancel the bass information found in the surround signal. Another logical but equally unacceptable choice would be to combine the bass of the decoded center channel signal and the decoded surround channel. But notice what happens when this is done. The resulting signal is equal to:

$$(L_t+R_t)+(L_t-R_t)=2L+1.414C+1.414jS.$$

This produces destructive interference of the right channel information. Thus, if the bass signal is only present in the original right channel signal, it will not be reproduced in such a system.

SUMMARY OF THE INVENTION

In general, in one aspect, the invention is a system for extracting a bass signal from left and right audio input signals of a stereo signal. The system includes a differencing circuit generating a difference mode signal from the left and right audio input signals; a detector circuit generating a first coefficient of proportionality that is a function of the relative phase of the left and right input signals; and a first multiplier circuit multiplying the first coefficient of proportionality times the difference mode signal to produce a modified difference mode signal, wherein the modified difference mode signal is used to generate the bass signal.

In preferred embodiments, the first coefficient of proportionality has the properties that: (1) its value approaches one when time average values of the absolute magnitude of the left and right audio input signals approach each other and they are out of phase; (2) its value equals one when only one of the left and right audio input signals is present; and (3) its value equals zero when the left and right audio input signals are in phase and its value is non-zero when the left and right audio input signals ae out of phase. The first coefficient of proportionality is a function of the absolute value of a time average of the left audio input signal minus the right audio input signal. More specifically, the first coefficient of proportionality is equal to $$K\left[1-\left(\frac{||\overline{L_{in}}|-|\overline{R_{in}}||}{|\overline{L_{in}-R_{in}}|}\right)\right].$$

Also in preferred embodiments, the system includes a first combiner circuit generating a common mode signal from the left and right audio input signals; and a second combiner circuit adding the modified difference mode signal and the common mode signal to produce an output signal, wherein the bass signal is derived from the output signal. The detector circuit generates a second coefficient of proportionality that is independent of the relative phase of the left and right audio input signals. The system also includes a second multiplier circuit multiplying the second coefficient of proportionality times the common mode signal to produce a modified common mode signal, wherein a center channel signal is derived from the modified common mode signal.

In addition, the system includes a first volume control circuit processing the modified difference mode signal to produce a surround channel signal with a user-adjustable gain and a second volume control circuit processing the modified common mode signal to produce a center channel signal with a user-adjustable gain. The system also includes a first low pass filter processing the output signal to produce a filtered signal; and a power amplifier amplifying the filtered signal, wherein the amplified signal is provided to drive a subwoofer.

In general, in another aspect, the invention a system for extracting bass signal from first and second audio input signals of an multichannel audio signal. The system includes a differencing circuit generating a difference mode signal from the first and second audio input signals; a detector circuit generating an output signal that is a function of the relative phase information contained in the first and second input signals; and a multiplier circuit multiplying the output signal of the detector circuit times the difference mode signal to produce a modified difference mode signal, wherein the modified difference mode signal is used to generate the bass signal.

Other advantages and features will become apparent from the following description of the preferred embodiment and from the claims.

DESCRIPTION OF THE PREFERRED EMBODIMENTS

Figure 1:
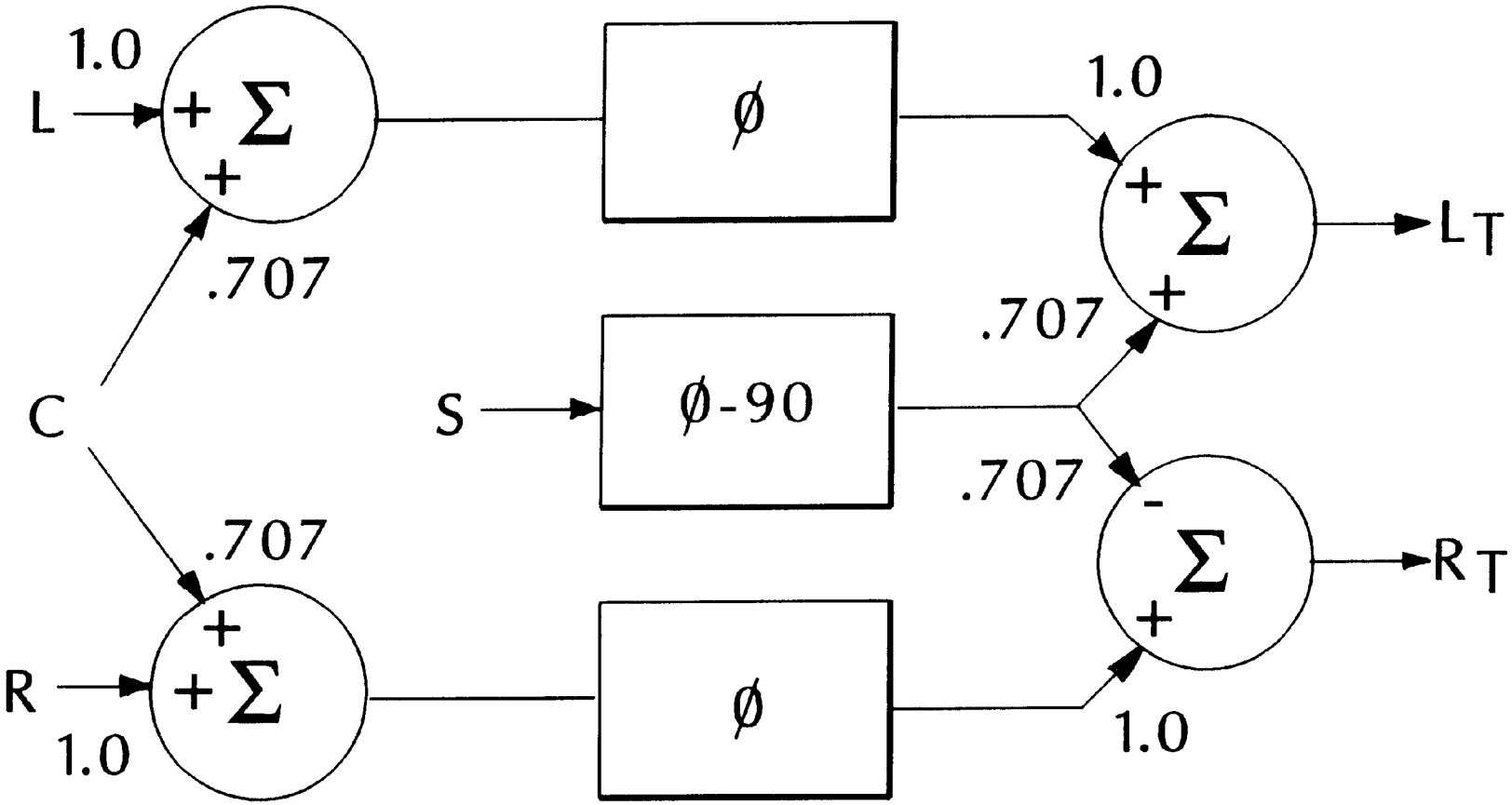
FIG. 1 is a block diagram of an encoding system.
Figure 2:
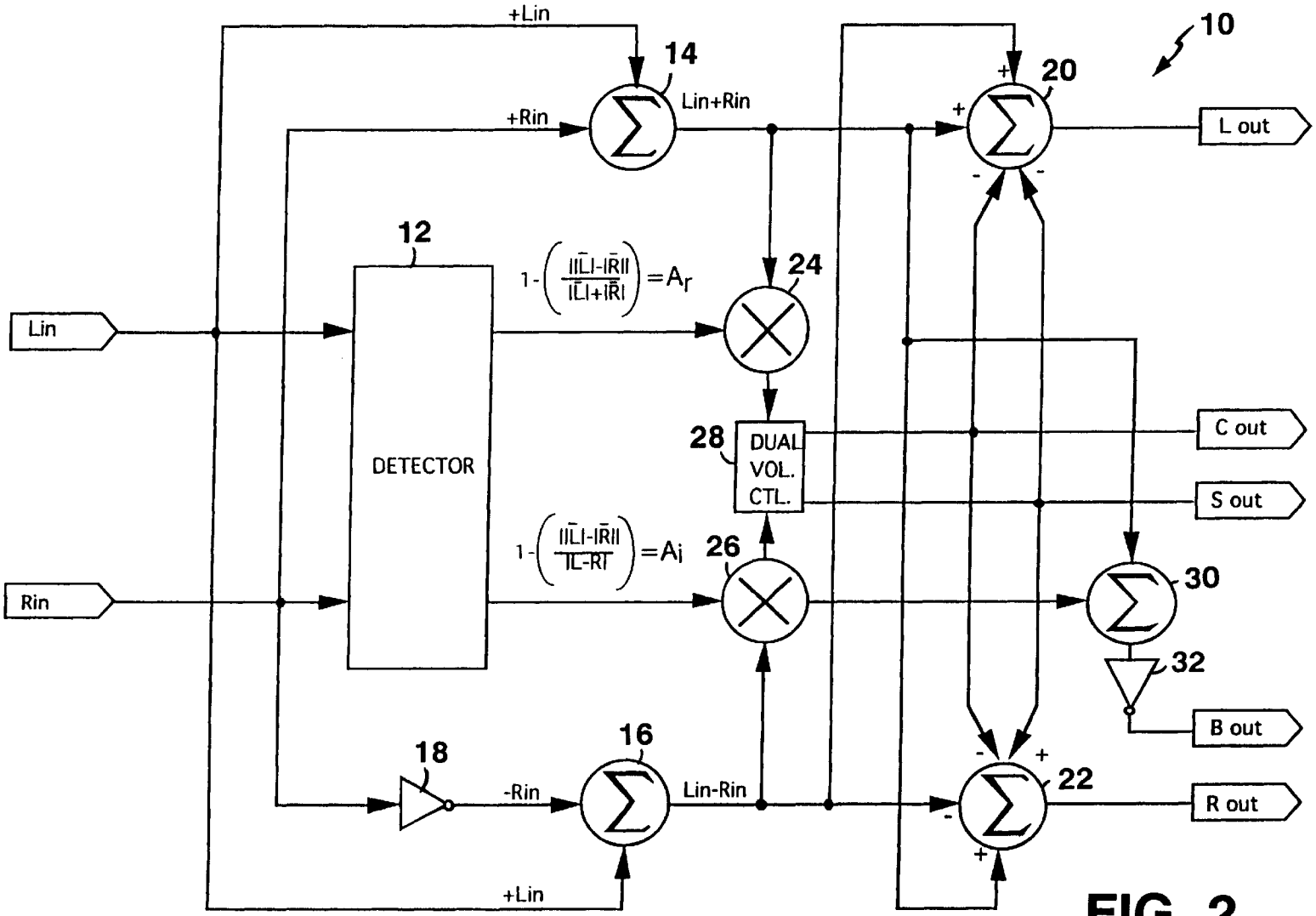
FIG. 2 is a block diagram of a surround decoder.

A decoder 10 which extracts a single composite bass signal from an encoded two channel stereo signal is shown in FIG. 2. The decoder receives as its input signals $L_{in}$, a left channel audio signal, and $R_{in}$, a right channel audio signal and it produces five output signals: $L_{out}$, $R_{out}$, $C_{out}$, $S_{out}$, and $B_{out}$. $L_{in}$ and $R_{in}$ are encoded audio signals in which other channel audio signals, such as a center channel audio signal and a surround channel audio signal, have been combined with a left and right channel audio signal. For example, $L_{in}$ and $R_{in}$ may be generated by using the previously described Dolby encoding technique which is illustrated in FIG. 1. $L_{out}$ and $R_{out}$ are the left and right channel audio signals, $C_{out}$ and $S_{out}$ are the center and surround channel output signals, and $B_{out}$ is a single bass channel output signal containing the bass information that was extracted from $L_{in}$ and $R_{in}$.

Decoder 10 includes a detector 12 which processes the $L_{in}$ and $R_{in}$ audio signals to produce two output signals $A_r$ and $A_i$. $A_r$ is referred to as the center channel coefficient and it is a function of the relative magnitudes of $L_{in}$ and $R_{in}$. $A_i$ is referred to as the surround channel coefficient and it is a function of the relative phases of $L_{in}$ and $R_{in}$. The precise values of the two outputs of detector 12 are as follows:

$$A_r = 1-\left(\frac{||\overline{L_{in}}|-|\overline{R_{in}}||+\epsilon}{|\overline{L_{in}}|+|\overline{R_{in}}|+\epsilon}\right)$$

$$A_i = 1-\left(\frac{||\overline{L_{in}}|-|\overline{R_{in}}||+\epsilon}{|\overline{L_{in}}|-|\overline{R_{in}}|+\epsilon}\right).$$

As will be explained in more detail below, these signals are used as coefficients to "extract" the real and imaginary information that is present within the left and right channel audio input signals. In these equations for the signals, $\epsilon$ is a small number which represents the offset currents of the circuitry which generates the signals. It has the practical effect of assuring that a singularity is not encountered at $L_{in}=R_{in}$ or at $L_{in}=R_{in}=0$. In the equations below, $\epsilon$ will not be explicitly included but it should be understood that it is nevertheless present.

Within decoder 10, a combiner circuit 14 adds $L_{in}$ and $R_{in}$ to produce a common mode signal, $L_{in}+R_{in}$. Another combiner circuit 16 with an inverter 18 on one its inputs adds $L_{in}$ to $-R_{in}$ to produce a difference mode signal, $L_{in}-R_{in}$. Both the common mode signal and the difference mode signal are each sent to two other combiner circuits 20 and 22, which combine these signals with other signals generated elsewhere in the decoder to produce $L_{out}$ and $R_{out}$, respectively.

The common mode signal and difference mode signal each pass to a different one of two multipliers 24 and 26. Multiplier 24 multiplies the common mode signal $L_{in}+R_{in}$ by $A_r$ and multiplier 26 multiplies the difference mode signal by $A_i$. The outputs of multipliers 24 and 26 pass to a dual volume control 28 which generates $C_{out}$ and $S_{out}$, respectively. The values of $C_{out}$ and $S_{out}$ are:

$$C_{out} = K_1(L_{in}+R_{in})\left[\left(1-\frac{||\overline{L_{in}}|-|\overline{R_{in}}||}{|\overline{L_{in}}|+|\overline{R_{in}}|}\right)\right]$$

$$S_{out} = K_2(L_{in}-R_{in})\left[1-\left(\frac{||\overline{L_{in}}|-|\overline{R_{in}}||}{|\overline{L_{in}-R_{in}}|}\right)\right],$$

where $K_1$ is the center channel gain that is applied to the common mode signal and $K_2$ is the surround channel gain that is applied to the difference mode signal.

Both of these signals are also passed to combiner circuits 20 and 22. Combiner circuit 20 combines its input signals to produce $L_{out}$ as follows:

$$L_{out}=(L_{in}+R_{in})+(L_{in}-R_{in})-C_{out}-S_{out}$$

Combiner circuit 22 combines its input signals to produce $R_{out}$ as follows:

$$R_{out}=(L_{in}+R_{in})-(L_{in}-R_{in})-C_{out}+S_{out}.$$

A fifth combiner circuit 30 followed by an inverter 32 produces the bass channel output signal $B_{out}$ by combining the common mode signal with the output of multiplier 26, i.e.:

$$B_{out} = (L_{in} + R_{in}) + (L_{in} - R_{in})\left[1 - \left(\frac{||L_{in}| - |R_{in}||}{|L_{in} - R_{in}|}\right)\right]$$

To understand the significance of coefficient $A_i$ it is helpful to see how it behaves for certain assumed conditions of the left and right input signals. For example, it should be readily apparent that $A_i$=0 for all situations in which there is no phase difference between the left and right channel audio signals $L_{in}$ and $R_{in}$. Such a condition exists when there is no surround sound content in the encoded signals. Under those conditions, the total bass signal is fully represented by the common mode signal and none of the difference mode signal contains any different bass information.

In the case, however, when the encoded left and right channel input signals have surround sound content, the difference signal will have an imaginary or complex component relative to the common mode signal. The $A_i$ coefficient is a measure of the imaginary component of the difference mode signal and it determines what proportion of the difference mode signal must be added to the common mode signal to get a more accurate representation of the total bass signal. The coefficient $A_i$ approaches one as the amount of out-of-phase components in the left and right channel input signals, $L_{in}$ and $R_{in}$, increases, and is at a maximum when the signals present at the left and right channel inputs are in phase opposition and of equal magnitude. $A_i$ is also equal to one when L=R=0, that is, when the original left and right channel signals that are combined with the center and surround channel signals to produce $L_{in}$ and $R_{in}$ are zero.

Also note that when there is either no left channel signal or no right channel signal in the encoded signal (i.e., when $L_{in}$ or $R_{in}$ equals zero), then $A_i$ also equals zero. Under those circumstances $B_{out}=L_{in}+R_{in}$, which will be non-zero assuming, of course, that the other channel does contain a signal. In other words, by using the decoding technique of the invention there will be no cancellation of the remaining signal as there would be by simply adding the common mode and difference mode signals.

The center channel coefficient $A_r$ is defined in such a way as to ignore the relative phase information of encoded the left and right channel audio signals. That is, the center channel coefficient is a function of only the magnitudes of the left and right channel input signals. Note that $A_r$ is a maximum when the magnitudes of $L_{in}$ and $R_{in}$ are equal and it goes to zero when either the left or right channel input signal goes to zero.

Figure 3:
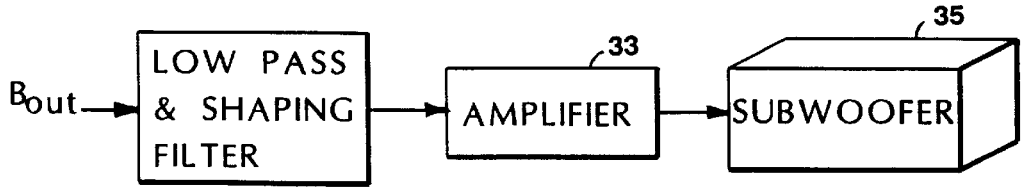
FIG. 3 is a block diagram of the bass circuit for driving a subwoofer.

The subwoofer signal is derived from $B_{out}$ as shown in FIG. 3. $B_{out}$ passes through a low pass filter and frequency shaping circuit 31 which eliminates the high frequency signal content or $B_{out}$ and shapes the frequency response for the low frequency information. The low-passed signal is then amplified by a power amplifier 33 and fed to the subwoofer 35.

Figure 4:
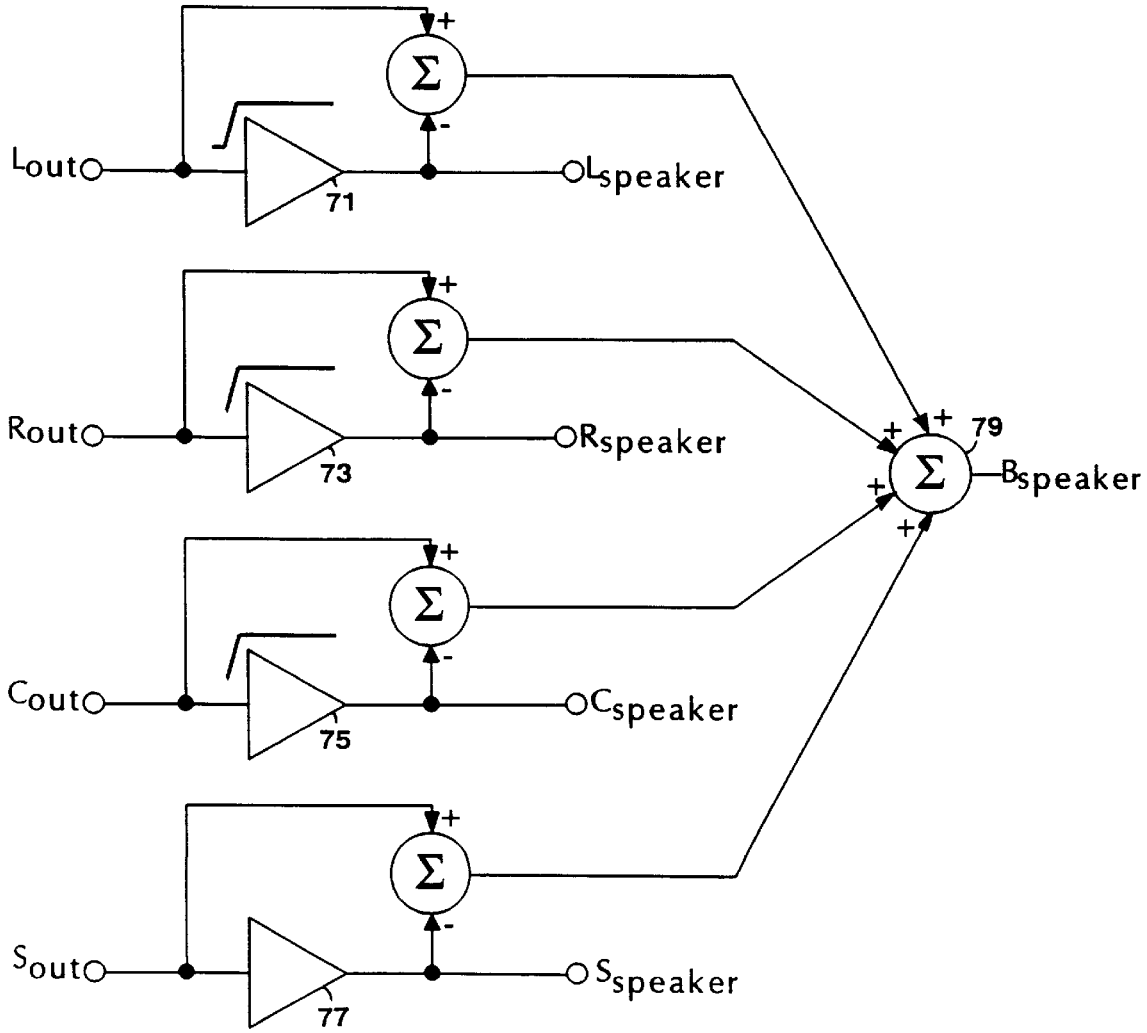
FIG. 4 is an alternative configuration for generating the total bass signal.

An alternative approach to generating the subwoofer signal is shown in FIG. 4. In this approach, the filtering is performed before combining the signals to produce the total bass signal. In other words, each of the signals, $L_{out}$, $R_{out}$, $C_{out}$, and $S_{out}$, is filtered by a corresponding high pass filter 71, 73, 75, and 77 to produce the signals that will drive the left, right, center and surround channel speakers. Each of the high pass filtered signals is also subtracted from its corresponding unfiltered signal to produce an associated bass component. The four bass components are then combined in a combiner circuit 79 to produce the total bass signal which is used to drive the subwoofer. Under this approach, different filtering characteristics can be applied to each of the decoded signals before they are combined to produce the total bass signal. It should be apparent that if the characteristics of filters 71, 73, 75, and 77 are identical, then the result will be the same as if a single filter was applied to $B_{out}$ of FIG. 2.

Figure 5:
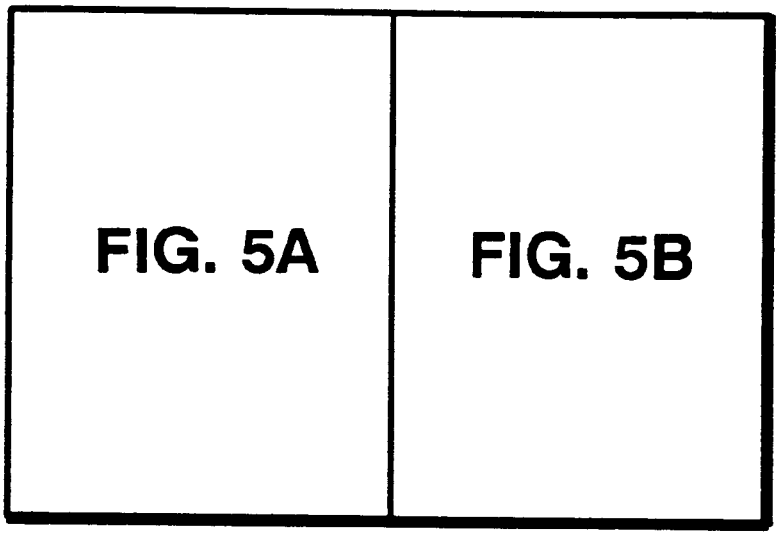
FIG. 5 is a detailed circuit diagram of a portion of a modified version of the system shown FIG. 2.
Figure 6:
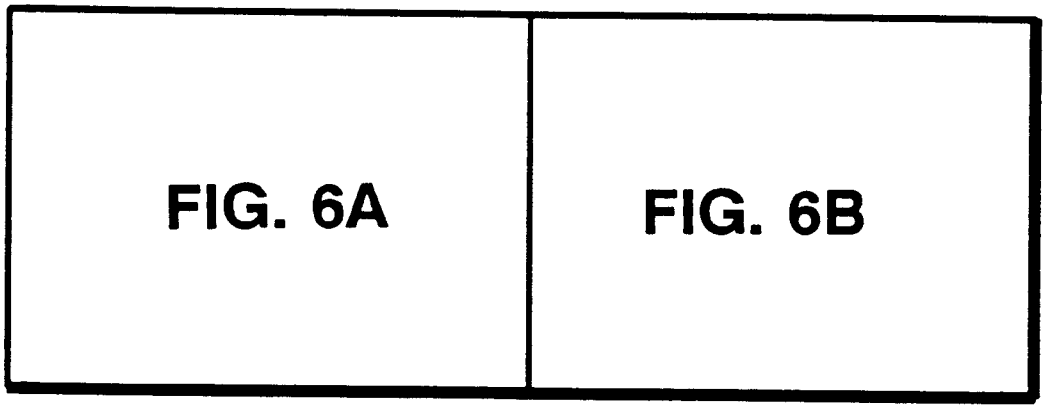
FIG. 6 is a detailed is another portion of the modified version of the system shown FIG. 2.
Figure 5A:
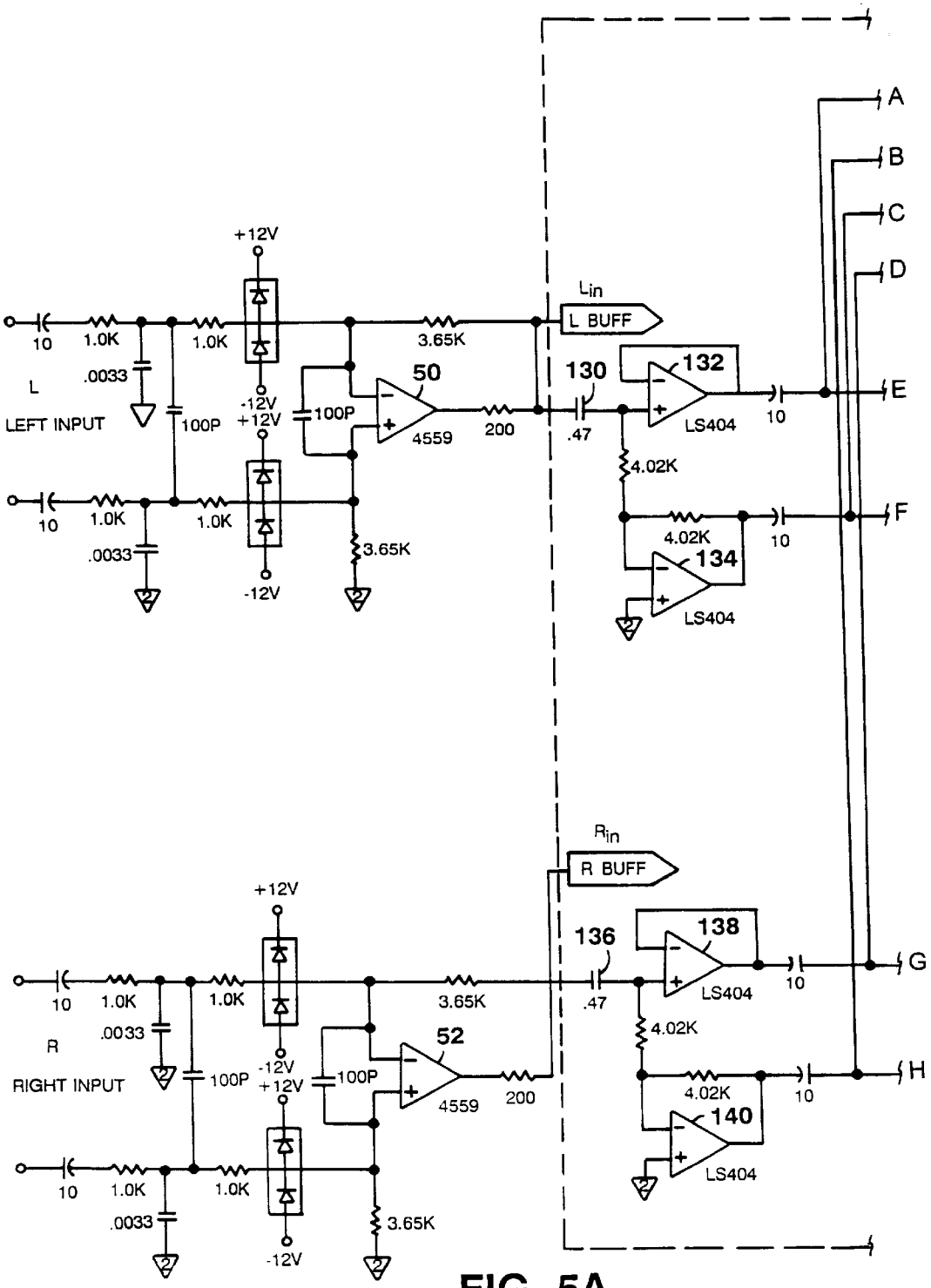
Figure 5B:
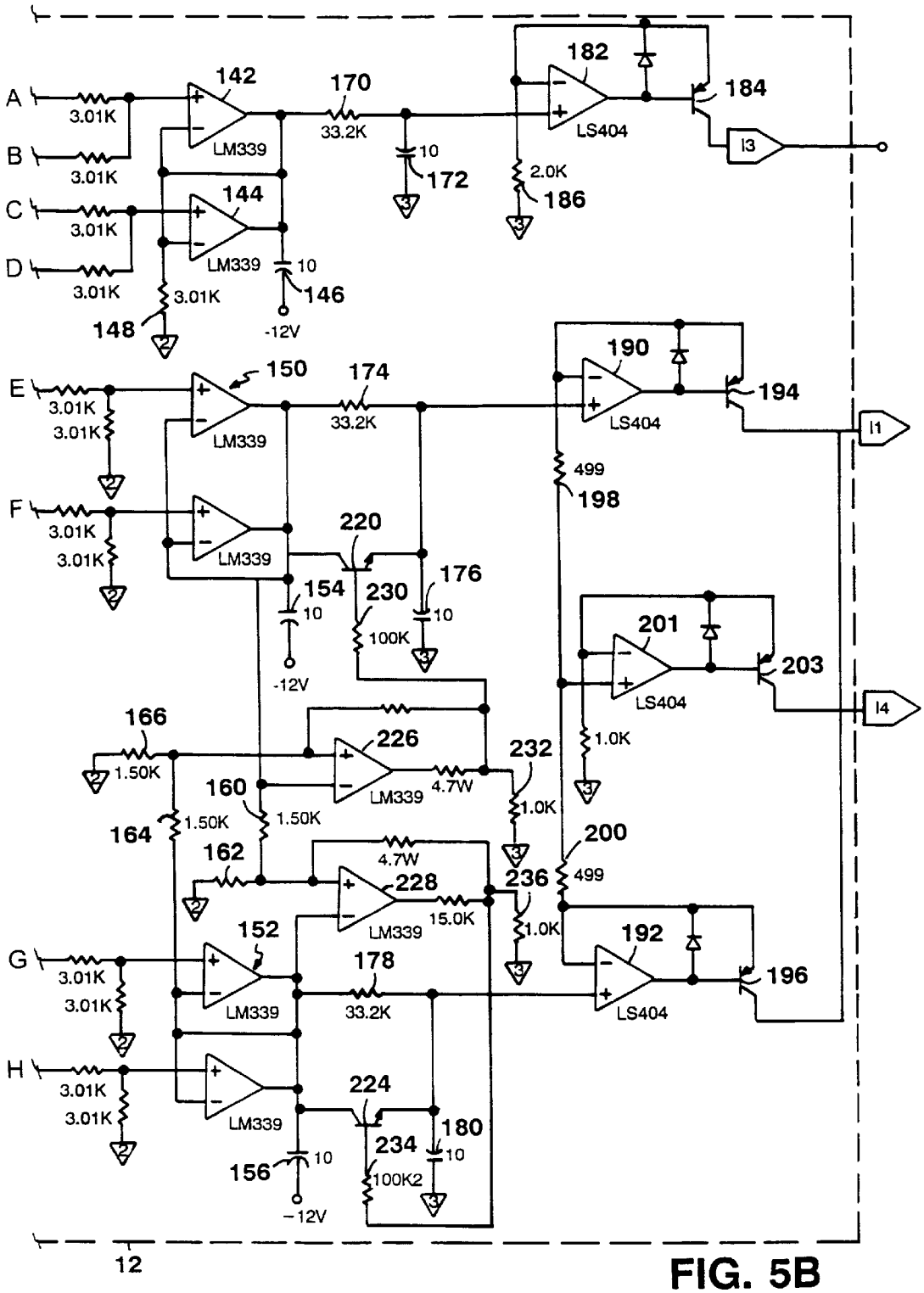
Figure 6A:
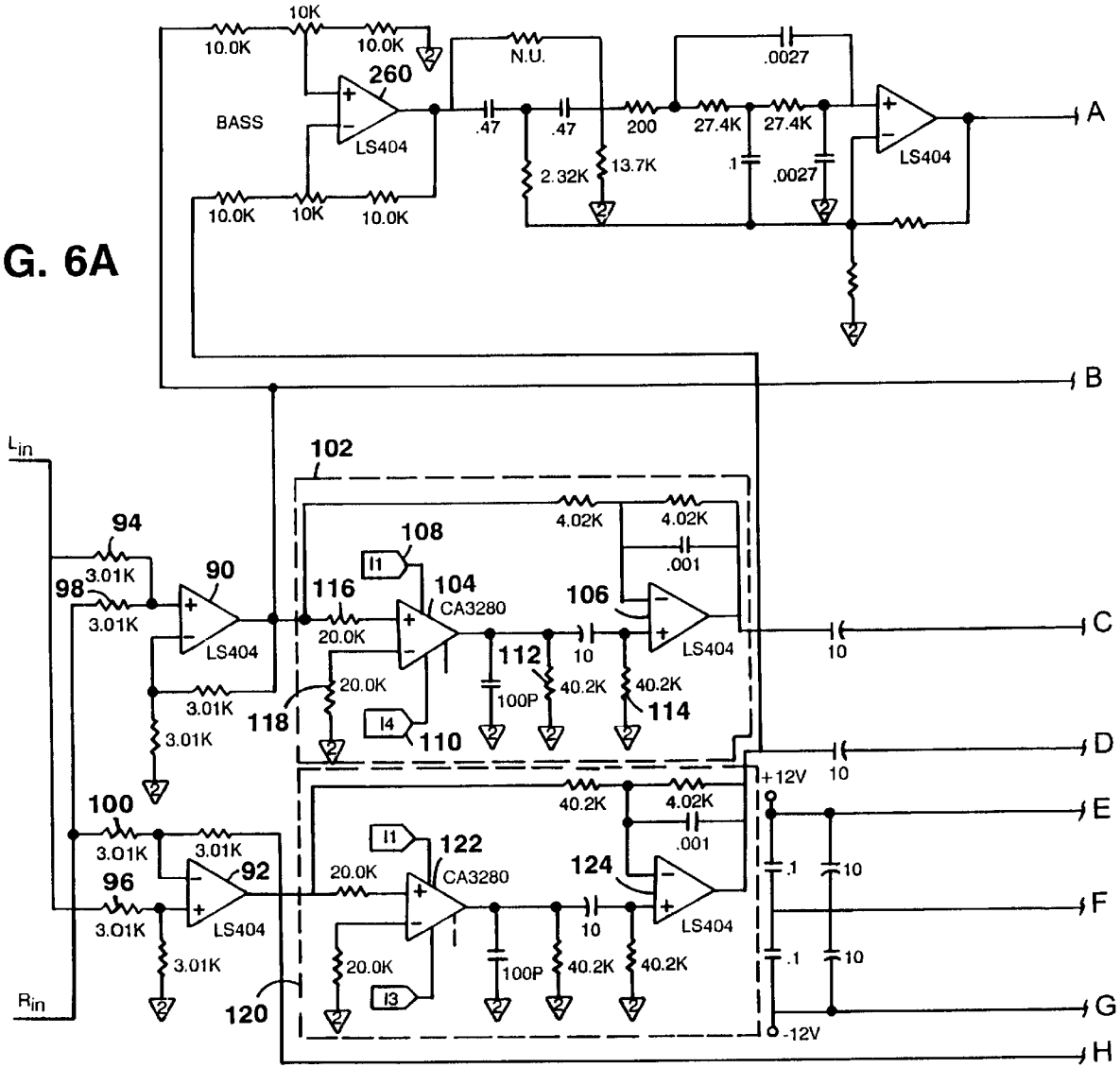
Figure 6B:
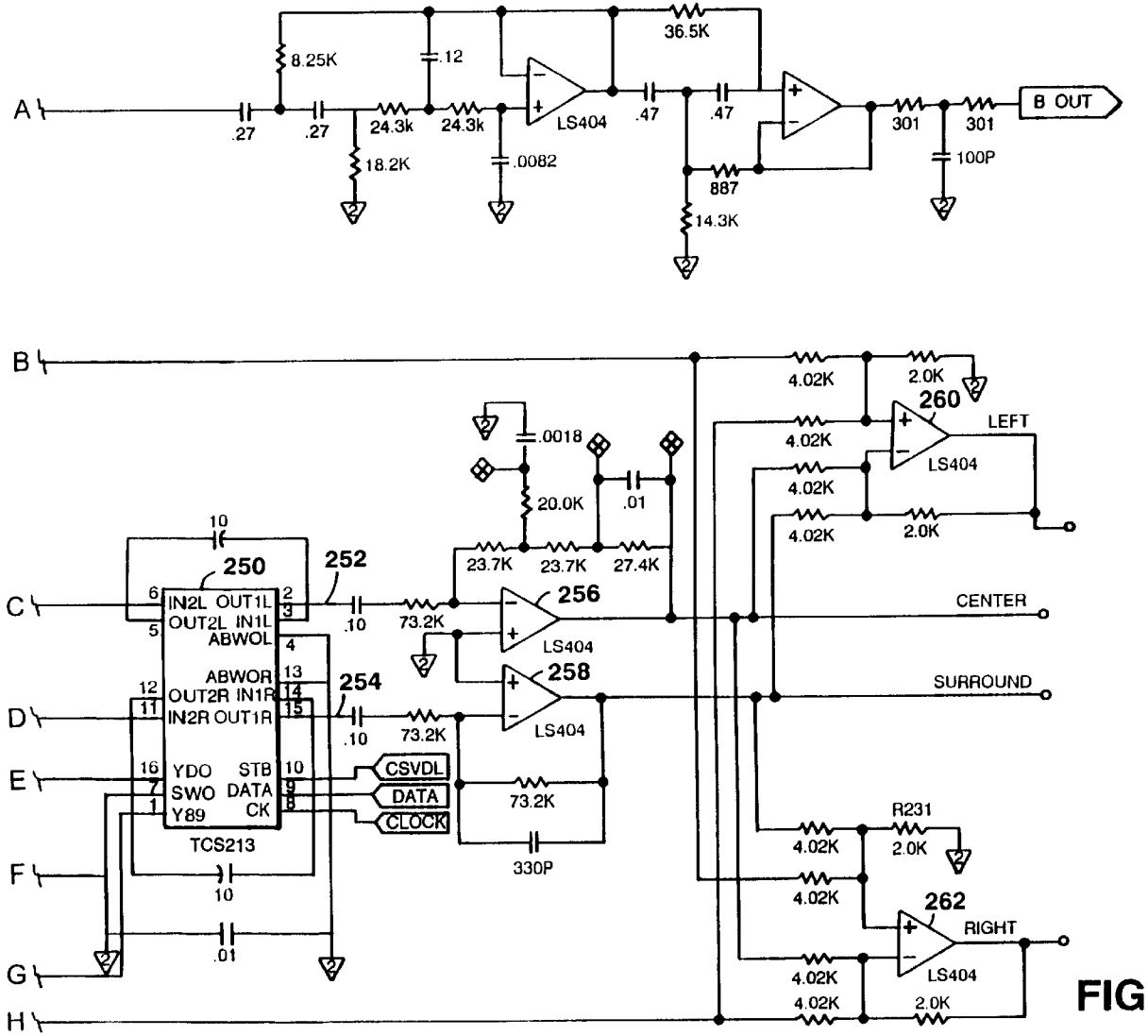

A more detailed circuit diagram of a slightly modified version of the above-described system is presented in FIGS. 5 and 6. The left and right audio input signals, L and R, are line-level, differential input signals. Each of the input signal is buffered by a corresponding balanced differential amplifier 50 and 52 to produce a left buffered signal, L-BUFF, and a right buffered signal, R-BUFF. L-BUFF and R-BUFF correspond to the signals which were previously identified as $L_{in}$ and $R_{in}$, respectively.

As shown in FIG. 6, the summing circuits 14 and 16 (see FIG. 2) are implemented by two differential amplifiers 90 and 92. $L_{in}$ is applied to the non-inverting inputs of amplifiers 90 and 92 through resistors 94 and 96, respectively. $R_{in}$ is applied to the non-inverting input of amplifier 90 through resistor 98 and to the inverting input of amplifier 92 through resistor 100. Both amplifiers are configured as unity gain amplifiers. Thus, the output voltage of amplifier 90 is equal to $L_{in}+R_{in}$, and the output voltage of amplifier 92 is equal to $L_{in}-R_{in}$.

The $L_{in}+R_{in}$ signal at the output of amplifier 90 is applied to the center channel current controlled gain cell 102 which is made up of a variable transconductance amplifier 104 and differential amplifier 106. The output signal of amplifier 104 is determined by the ratio of two currents $I_1$ and $I_4$ that are applied at terminals 108 and 110, respectively. The transfer function of amplifier 104 is $$V_{out} = \frac{I_1 R_1}{I_4 R_{in}} V_{in},$$

where $R_1$ is the parallel combination of output resistors 112 and 114 and $R_{in}$ is the series combination of input resistors 116 and 118. In this instance, $R_1$ and $R_{in}$ are 20.1 k ohms and 40 k ohms, respectively.

For the condition of $I_1$ equal to $I_4$, the output of transconductance amplifier 104 is 0.5 times the input signal to the current controlled gain cell. This signal is, in turn, amplified by a factor of 2 by amplifier 106. The current $I_1$ is bounded by the condition that $I_1$ is less than or equal to $I_4$.

The output of amplifier 90 is also amplified by amplifier 106, which for this input is configured to have a voltage gain of minus 1. Thus, the total output voltage of amplifier 106 is the difference of its two input signals and can be expressed by the following equation:

$$C_{int} = -(L_{in} + R_{in})\left[1 - \frac{I_1}{I_4}\right].$$

The $L_{in}-R_{in}$ signal at the output of amplifier 92 is applied to the surround channel current controlled gain cell 120 which is made up of a transconductance amplifier 122 and a differential amplifier 124. The operation of this gain cell is identical to that of the center channel current controlled gain cell except that the current ratios are $I_1$ divided by $I_3$ and the current $I_1$ is bounded by the condition that $I_1$ is less than or equal to $I_3$. In this case, the total output voltage from amplifier 124 is expressed by the following equation:

$$-S_{int} = -(L_{in} - R_{in})\left[1 - \frac{I_1}{I_3}\right].$$

The currents $I_1$, $I_3$ and $I_4$ which control the operation of transconductance amplifiers 104 and 122 are generated elsewhere in the system from $L_{in}$ and $R_{in}$. Referring again to FIG. 5, the left buffered signal, $L_{in}$, is applied through a capacitor 130 to the input of a unity gain amplifier 132 and to the input of an inverter 134. Similarly, the right buffered signal, $R_{in}$, is applied through a capacitor 136 to the input of a unity gain amplifier 138 and to the input of an inverter 140. The output signals of amplifier 132 and inverter 140 are summed at the non-inverting input of a comparator 142 and the output signals of amplifier 138 and inverter 134 are summed at the non-inverting input of a second comparator 144. The output of comparator 142 is equal to 0.5 ($L_{in}$–$R_{in}$) and the output of comparator 144 is equal to 0.5 ($R_{in}$–$L_{in}$).

Comparators 142 and 144 are open-collector voltage comparators. Their outputs are wire-o'red with negative feedback applied around the comparators. Since the comparator can only sink current with respect to ground, each comparator is responsive only to the negative polarity (with respect to ground) of the input signal at each non-inverting input and thus essentially half-wave rectifies its input signal. The outputs of comparators 142 and 144 are summed at a capacitor 146 and averaged by the parallel combination of capacitor 146 with resistor 148. Thus, the voltage across capacitor 142 constitutes the negative absolute value of $L_{in}$ minus $R_{in}$ averaged over time (i.e., $\overline{|L_{in}-R_{in}|}$).

Similarly constructed full-wave rectifying circuits 150 and 152 individually process the $L_{in}$ and $R_{in}$ signals to produce time-averaged signals. In other words, the output voltage of circuit 150 across capacitor 154 is the negative absolute value of $L_{in}$ averaged over time, and the output voltage of circuit is the negative absolute value of $R_{in}$ averaged over time. Resistors 160 plus 162 in parallel with capacitor 154 constitute the averaging circuit for $L_{in}$, and resistors 164 plus 166 in parallel with capacitor 156 constitute the averaging circuit for $R_{in}$. In the described embodiment, the values are chosen to produce a relatively fast time constant for each circuit, e.g. approximately 30 milli-seconds.

The signal at the output of the first-mentioned rectifying circuit (i.e. comparators 142 and 144) is further time averaged by an RC circuit made up of the series combination of resistor 170 and capacitor 172 which are selected to have a time constant of about 330 milli-seconds. Similarly, a second RC circuit that is connected to the output of rectifying circuit 150 (i.e., resistor 174 and capacitor 176) and a third RC circuit that is connected to the output of rectifying circuit 152 (i.e., resistor 178 and capacitor 180) provide averaging time constants for $L_{in}$ and $R_{in}$, respectively. In the described embodiment, these time constants are also selected to be about 330 milli-seconds.

The voltage across capacitor 172 at the output of the first-mentioned rectifying circuit is converted to a current by the combination of a differential amplifier 182 and a transistor 184. The output of amplifier 182 drives the base of transistor 184 and the signal at the emitter of transistor 184 is fed back to the amplifier's inverting input, which is connected to ground through a resistor 186. The voltage across capacitor 172 drives the non-inverting input of amplifier 182. Thus, the magnitude of the current produced at the collector of transistor 184 is determined by the voltage at the non-inverting input of amplifier 182 divided by the resistance of resistor 186. This current is $I_3$ and is equal to $$\frac{\overline{|L_{in} - R_{in}|}}{R_{186}}.$$

Similarly, the voltages across capacitors 176 and 180 are converted to currents using the above-described configuration as current sources. In particular, the voltage across capacitor 176 drives the non-inverting input of an amplifier 190 which controls the operation of transistor 194 and the voltage across capacitor 180 drives the non-inverting input of an amplifier 192 which controls the operation transistor 196. The inverting inputs of amplifiers 190 and 192 are connected together through resistors 198 and 200. The collectors of transistors 194 and 196 are connected together to sum the collector currents and thereby generate $I_1$, which is equal to $$\frac{\overline{|L_{in}|} - \overline{|R_{in}|}}{R_{10}},$$

where $R_{10}$ is the total series resistance of resistors 198 and 200.

To generate $I_4$, another current source including differential amplifier 201 and transistor 203 is used. The voltage at the connection between resistors 198 and 200 drives the non-inverting input of amplifier 203. The collector current of transistor 203 is $I_4$ which equals $$\frac{\overline{|L_{in}|} + \overline{|R_{in}|}}{R_{11}},$$

where $R_{11}$ equals the value of a resistor 205 connected between the inverting input and ground.

One half of $I_1$ is applied transconductance amplifier 104 and one half of $I_1$ is applied to the other transconductance amplifier 122. Note that the value of resistor 186 is chosen to be twice that of the series resistance of resistors 198 and 200. Since the current $I_1$ is divided in half for the transconductance amplifiers, the relationship between currents $I_3$ and $I_1$ are identical for an $L_{in}$ or $R_{in}$ only input signal condition. The currents $I_1$ and $I_3$ may be conveniently expressed as a function of $L_{in}$ and $R_{in}$ and the equation for $S_{out}$ can then be rewritten as follows:

$$S_{out} = (L_{in} - R_{in})\left[1 - \left(\frac{\|\overline{|L_{in}|} - \overline{|R_{in}|}\|}{\overline{|L_{in} - R_{in}|}}\right)\right].$$

Similarly, the current $I_4$ can also be conveniently expressed as a function of $L_{in}$ and $R_{in}$ and the equation for $C_{out}$ can then be rewritten as follows:

$$C_{out} = (L_{in} + R_{in})\left[\left(1 - \frac{\|\overline{|L_{in}|} - \overline{|R_{in}|}\|}{\overline{|L_{in}|} + \overline{|R_{in}|}}\right)\right].$$

Note that there is a transistor 220 connected between capacitors 154 and 170 which serves to produce an adaptive time constant for rectifying circuit 150. Similarly, a transistor 224 connected between capacitors 150 and 180 serves to produce an adaptive time constant for rectifying circuit 152. Under transient signal conditions, the transistors turn on to decrease the time constant and thereby increase the response speed of the circuit. These speed-up circuits operate as follows.

The inverting input of a comparator 226 which drives the base of transistor 220 looks at the time averaged value of $L_{in}$ across capacitor 154. The non-inverting input of comparator 226 looks at one half the time averaged value of $R_{in}$, i.e., the voltage produced by a voltage divider made up of resistors 164 and 166. The inverting input of another comparator 228 which drives the base of transistor 224 looks at the value of $R_{in}$ that appears across capacitor 156. The non-inverting input of comparator 228 looks at one half the value of $L_{in}$.

Transistors 220 and 224 behave as saturated switches (large signal) when their base-emitter junctions are forward biased. For the condition $L_{in}$ equal to $R_{in}$, the voltages at the inverting inputs of comparators 226 and 228 are equal. The output terminal of each comparator is open. Thus, the base of transistor 220 is referenced to ground through resistor 230 in series with resistor 232; and the base of transistor 224 is referenced to ground through resistor 234 in series with resistor 236. In the steady state case, the voltages at capacitors 176 and 180 are equal, and reflect the negative absolute mean values of $L_{in}$ and $R_{in}$, respectively.

As this value approaches the base to emitter voltage of transistors 220 and 224, transistors 220 and 224 are conducting, (collector to emitter) and the time constant is adaptively faster for large signal conditions, and slower for small signal conditions. Note that in the large signal case (i.e., transistors 220 and 224 conducting), if $L_{in}$ and $R_{in}$ have equal magnitudes the circuits have approximately equal time constants. However, if the value of $L_{in}$ becomes slightly more than twice that of $R_{in}$, the time constant of the $L_{in}$ side of the circuit becomes faster than that of $R_{in}$ side of the circuit since the output of comparator 228 is active low (−12 volts) and the base to emitter junction of transistor 224 is turned off. The behavior of the circuit is symmetrical with respect to $R_{in}$ being slightly more than twice the value of $L_{in}$.

Returning to FIG. 6, the output signals of amplifiers 106 and 124 are applied to a digitally-controlled, two channel, volume control 250 with independent control of each section. This volume control produces the adjustable coefficients by which the derived center channel and surround channel signals are multiplied, namely, $K_1$ and $K_2$.

Each output signal 252 and 254 of the digital volume control 250 is amplified by a corresponding one of amplifiers 256 and 258. Both amplifiers 256 and 258 are configured to provide a voltage gain of −1 with some frequency shaping of each signal. The specific frequency shaping is not restricted to that shown in FIG. 6 and can be adapted to be any derived function. The output of amplifier 256 corresponds to $C_{out}=K_{1t}C_{int}$ and the output of amplifier 258 corresponds to $S_{out}=K_{2t}S_{int}$, where $K_{1t}$ and $K_{2t}$ correspond to the volume control gain times the frequency shaping function implemented by the amplifier. To the first order (without frequency shaping and with $K_1$ and $K_2$ equal to 1), the output signals of amplifiers 256 and 258 constitute the complete center and surround signals.

The bass channel signal is defined by the sum of $L_{in}$ and $R_{in}$ (i.e., the output signal of amplifier 90) plus the derived surround signal (i.e. the output signal of amplifier 124). A bass summing amplifier 260 combines the outputs of amplifiers 90 and 124 to produce the bass channel signal. The output of amplifier 90 (i.e., $L_{in}+R_{in}$) drives the non-inverting input of amplifier 260 and the output of amplifier 124 (i.e., $-S_{int}$) drives the inverting input. Thus, the output of amplifier 260 is:

$$L_{in}+R_{in}-(-S_{int})$$

or simply, $$L_{in}+R_{in}+S_{int}$$

The remaining circuitry following amplifier 260 represents a bass channel active equalization circuit which in the illustrated embodiment is a bandpass filter having a bandwidth of approximately 45 hz to 200 hz. Of course, the specific details of the active equalization is a matter of design choice.

The summing circuits 20 and 22 of FIG. 2 are implemented by amplifiers 260 and 262 in FIG. 6. The output of amplifier 260 is:

$$L_{out}=0.5[(L_{in}+R_{in})+(L_{in}-R_{in})-K_{1t}C_{int}-K_{t2}S_{int}],$$

and the output of amplifier 262 is:

$$R_{out}=0.5[(L_{in}+R_{in})-(L_{in}-R_{in})-K_{1t}C_{int}+K_{2t}S_{int}].$$

The coefficients $K_{1t}$ and $K_{2t}$ are the values of the volume control settings as well as the frequency shaping which is determined by the component values around the feedback loop of amplifiers 256 and 258. In this instance, the center channel signal is a combination high-pass and band reject filter, having a −3.0 dB cutoff of 20 hZ and a −2.0 dB dip at 2 kHz. The surround channel signal is a simple band-pass signal with a −3.0 dB cutoff of 20 Hz and 7 kHz. Since the left and right channel signals are a function of $C_{int}$ and $S_{int}$, the entire matrix is constant power.

The derived left, right, center, and surround signals (i.e., $L_{out}$, $R_{out}$, $C_{out}$ and $S_{out}$) are applied to their corresponding equalizer circuits which are essentially bandpass circuits having a bandwidth from 200 Hz to 20 kHz. The specific design of these equalizer circuits is, of course, a matter of design choice.

Note that alternatively the bass signal could be derived by summing the signals appearing at the outputs of amplifiers 256, 258, 260, and 262. In that case, different bass equalization circuits can be used for each component of the bass signal, as previously described.

Also note that the coefficients $K_{1t}$ and $K_{2t}$ provide certain advantages, namely, by adjusting either one, the user can control the plane of the acoustic image. For instance with $K_{1t}$, which is the center channel coefficient that is a function of frequency, the user can by adjusting it send some of the center channel signal to the left and right speakers. This has the psychoacoustical effect of altering the plane of the center channel acoustical image. By adjusting $K_{1t}$, the user can raise or lower the location of the acoustical image. This is particualarly advantageous in home theater systems in which it is typically not possible to place the center channel speaker behind the screen where it righfully should be. Instead, the speaker is usually placed below the screen. By adjusting $K_{1t}$ and thereby sending some of the center channel signal to the left and right speakers on either side of the screen, the location of the center channel acoustical image can be moved up to the center of the screen.

Other embodiments are within the following claims. For example, though it was assumed for the above embodiment that the left and right channel signals were Dolby encoded signals, they could be any two signals whether encoded or not and if they are encoded, it could be by any encoding scheme, not limited to Dolby encoding. In other words, the invention works to effectively extract a single bass signal from any two or more encoded or non-encoded signals. If more than two signals are being processed, they can be processed in pairwise combinations using the above scheme to pull out the common bass from all of the signals.

What is claimed is:

1. A system for extracting a bass signal from left and right audio input signals of a stereo signal, said system comprising:

a differencing circuit generating a difference mode signal from the left and right audio input signals;

a detector circuit generating a first coefficient of proportionality that is a function of the relative phase of the left and right input signals; and a first multiplier circuit multiplying the first coefficient of proportionality times the difference mode signal to produce a modified difference mode signal, wherein the modified difference mode signal is used to generate the bass signal.

2. The system of claim 1 wherein the first coefficient of proportionality has the property that its value approaches one when time average values of the absolute magnitude of the left and right audio input signals approach each other and they are out of phase.

3. The system of claim 2 wherein the first coefficient of proportionality has the property that its value equals one when only one of the left and right audio input signals is present.

4. The system of claim 1 wherein the first coefficient of proportionality has the property that its value equals zero when the left and right audio input signals are in phase and its value is non-zero when the left and right audio input signals are out of phase.

5. The system of claim 4 wherein the first coefficient of proportionality is a function of the absolute value of a time average of the left audio input signal minus the right audio input signal.

6. The system of claim 5 wherein the first coefficient of proportionality is equal to $$K\left[1-\left(\frac{\left|\overline{|L_{in}|}-\overline{|R_{in}|}\right|}{\overline{|L_{in}-R_{in}|}}\right)\right],$$

where $L_{in}$ equals the left audio input signal, $R_{in}$ equals the right audio input signal, and K is a scaling factor.

7. The system of claim 6 wherein K is a function of frequency.

8. The system of claim 1 further comprising:

a first combiner circuit generating a common mode signal from the left and right audio input signals; and a second combiner circuit adding the modified difference mode signal and the common mode signal to produce an output signal, wherein the bass signal is derived from the output signal.

9. The system of claim 1 wherein the detector circuit generates a second coefficient of proportionality that is independent of the relative phase of the left and right audio input signals.

10. The system of claim 9 wherein the second coefficient of proportionality is a function of the magnitude of the left input signal and the magnitude of the right audio input signal.

11. The system of claim 9 wherein the second coefficient of proportionality is equal to $$K\left[1-\left(\frac{\left|\overline{|L_{in}|}-\overline{|R_{in}|}\right|}{\overline{|L_{in}|}+\overline{|R_{in}|}}\right)\right],$$

where $L_{in}$ equals the left audio input signal, $R_{in}$ equals the right audio input signal, and K is a scaling factor.

12. The system of claim 10 further comprising a second multiplier circuit multiplying the second coefficient of proportionality times the common mode signal to produce a modified common mode signal that is a center channel signal.

13. The system of claim 1 further comprising a first volume control circuit processing the modified difference mode signal to produce a surround channel signal with a user-adjustable gain.

14. The system of claim 13 further comprising a second volume control circuit processing the modified common mode signal to produce a center channel signal with a user-adjustable gain.

15. The system of claim 8 further comprising:

a first low pass filter processing the output signal to produce a filtered signal; and a power amplifier amplifying the filtered signal, wherein the amplified signal is provided to drive a subwoofer.

16. The system of claim 8 further comprising:

a subwoofer;

a first low pass filter processing the output signal to produce a filtered signal;

a power amplifier amplifying the filtered signal and driving the subwoofer with the amplified filtered signal.

17. The system of claim 4 wherein the detector circuit generates a second coefficient of proportionality that is independent of the relative phase of the left and right audio input signals and that is a function of the magnitude of the left input signal and the magnitude of the right audio input signal, said system further comprising:

a first combiner circuit generating a common mode signal from the left and right audio input signals; and a second multiplier circuit multiplying the second coefficient of proportionality times the common mode signal to produce a modified common mode signal, wherein a center channel signal is derived from the modified common mode signal.

18. The system of claim 17 further comprising a first volume control circuit processing the modified difference mode signal to produce a surround channel output signal with a user-adjustable gain.

19. The system of claim 18 further comprising a second volume control circuit processing the modified common mode signal to produce a center channel output signal with a user-adjustable gain.

20. The system of claim 19 further comprising:

a second combiner circuit combining the left audio input signal, the center channel signal and the surround channel signal to produce a left channel output signal;

a third combiner circuit combining the right audio input signal, the center channel signal and the surround channel signal to produce a right channel output signal; and a fourth combiner circuit for combining the left channel output signal, the right channel output signal, the surround channel output signal and the center channel output signal to produce a composite signal from which the bass signal is derived.

21. A system for extracting bass signal from first and second audio input signals of an multichannel audio signal, said system comprising:

a differencing circuit generating a difference mode signal from the first and second audio input signals;

a detector circuit generating an output signal that is a function of the relative phase information contained in the first and second input signals; and a multiplier circuit multiplying the output signal of the detector circuit times the difference mode signal to produce a modified difference mode signal, wherein the modified difference mode signal is used to generate the bass signal.

22. The system of claim 21 further comprising:

a first combiner circuit generating a common mode signal from the left and right input signals; and a second combiner circuit adding the modified difference mode signal and the common mode signal to produce an output signal, wherein the bass signal is derived from the output signal.

23. The system of claim 22 wherein the first coefficient of proportionality has the property that its value equals zero when there is the left and right audio input signals are in phase and its value is non-zero when the left and right audion input signals are out of phase.

24. The system of claim 23 wherein the first coefficient of proportionality has the property that its value equals one when only one of the left and right audio input signals is present.

25. The system of claim 22 wherein the first coefficient of proportionality is equal to $$K\left[1-\left(\frac{\left|\,|\overline{L_{in}}|-|\overline{R_{in}}|\,\right|}{|\overline{L_{in}-R_{in}}|}\right)\right],$$

where $L_{in}$ equals the left audio signal, $R_{in}$ equals the right audio signal, and K is a scaling factor.

26. The system of claim 25 wherein K is a function of frequency.

27. The system of claim 22 further comprising:

a first low pass filter processing the output signal to produce a filtered signal; and a power amplifier amplifying the filtered signal, wherein the amplified signal is provided to drive a subwoofer.

28. The system of claim 12 and further comprising at least left and right summing circuits providing left and right output signals $L_{out}$ and $R_{out}$ respectively characterized by the following equations:

$$L_{out}=0.5[(L_{in}+R_{in})+(L_{in}-R_{in})-K_{1t}C_{int}-K_{2t}S_{int}],$$

$$R_{out}=0.5[(L_{in}+R_{in})-(L_{in}-R_{in})-K_{1t}C_{int}+K_{2t}S_{int}],$$

wherein $L_{in}$ and $R_{in}$ are left and right components respectively of an input stereo signal, $K_{1t}$ and $K_{2t}$ are coefficients representative of volume control gain and frequency shaping function associate with a respective center channel and surround amplifier respectively and $C_{int}$ and $S_{int}$ are input signals to said center and surround amplifiers respectively, and a usable adjuster control for controlling the center channel coefficient $K_{1t}$ to allow altering the plane of the center channel acoustical image so that the user can raise or lower the location of the acoustical image.

29. The system of claim 28 and further comprising, an image display screen, left and right speakers to the left and right of said image display screen respectively coupled to said left and right summing circuits respectively constructed and arranged to electroacoustically transduce said left and right output signals respectively, and a center channel speaker above or below said display screen so that user adjustment of said coefficient $K_{1t}$ allows the location of the center channel acoustical image to move to the center of the screen.

* * * * *

UNITED STATES PATENT AND TRADEMARK OFFICE

CERTIFICATE OF CORRECTION

PATENT NO. : 6,240,189 B1
APPLICATION NO. : 08/254643
DATED : May 29, 2001
INVENTOR(S) : J. Richard Aylward It is certified that error appears in the above-identified patent and that said Letters Patent is hereby corrected as shown below:

Column 4, line 20, Formula $A_i$, that portion of the formula reading "$\lceil L_{in} \rceil$ -- $\lceil R_{in} \rceil + \varepsilon$ "

should read -- $\lceil L_{in}$ -- $R_{in} \rceil + \varepsilon$ --.

Signed and Sealed this

Twenty-ninth Day of May, 2007

JON W. DUDAS
*Director of the United States Patent and Trademark Office*